US007137849B2

(12) United States Patent
Nagata

(10) Patent No.: US 7,137,849 B2
(45) Date of Patent: Nov. 21, 2006

(54) CONNECTOR

(75) Inventor: Takayuki Nagata, Higashiosaka (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 10/526,202

(22) PCT Filed: Aug. 26, 2003

(86) PCT No.: PCT/JP03/10807

§ 371 (c)(1),
(2), (4) Date: Mar. 1, 2005

(87) PCT Pub. No.: WO2004/023604

PCT Pub. Date: Mar. 18, 2004

(65) Prior Publication Data

US 2005/0282439 A1 Dec. 22, 2005

(30) Foreign Application Priority Data

Sep. 3, 2002 (JP) ..... 2002-257894

(51) Int. Cl.
*H01R 24/00* (2006.01)

(52) U.S. Cl. ..... 439/630

(58) Field of Classification Search ..... 439/630, 439/63, 61, 495, 499, 280, 573, 497, 733.1, 439/541.5, 260, 637

See application file for complete search history.

(56) References Cited

U.S. PATENT DOCUMENTS

| | | | | |
|---|---|---|---|---|
| 5,401,186 | A * | 3/1995 | Nozaki et al. | 439/495 |
| 6,758,696 | B1 * | 7/2004 | Farnworth et al. | 439/632 |
| 6,939,166 | B1 * | 9/2005 | Chung | 439/495 |

FOREIGN PATENT DOCUMENTS

| | | |
|---|---|---|
| JP | 3156872 | 7/1991 |
| JP | 04-250515 | 9/1992 |
| JP | 08-017528 | 1/1996 |
| JP | 08-186628 | 7/1996 |
| JP | 08-213117 | 8/1996 |
| JP | 09-082439 | 3/1997 |
| JP | 10027659 | 1/1998 |
| JP | 2001-266981 | 9/2001 |
| JP | 2002-124321 | 4/2002 |

* cited by examiner

*Primary Examiner*—J. F. Duverne
(74) *Attorney, Agent, or Firm*—The Webb Law Firm

(57) ABSTRACT

Disclosed are contact members which have elastically deformable points of contact formed in two locations, and a main connector body for insulating and holding a plurality of contact members arranged at intervals in a width direction with the points of contact in the two locations of the respective contact members being in the same positions as seen in the direction of arrangement. The main connector body includes a pair of socket portions for receiving board ends defining land electrodes in two rows corresponding to the points of contact of the respective contact members lying in the same positions as seen in the direction of arrangement, so that the land electrodes are in pressure contact with the corresponding points of contact.

15 Claims, 8 Drawing Sheets

FIG.5(b) X-X

CONNECTOR

TECHNICAL FIELD

The present invention relates to a connector for connecting printed circuit boards, flexible printed wiring boards (hereinafter abbreviated to FPC), or a printed circuit board and an FPC, for example.

BACKGROUND ART

As shown in FIGS. 10 (*a*), 10 (*b*) and 10 (*c*), the above connector is used, for example, in a bending part (hinged part) of a folding type cell phone for connecting printed circuit boards in an upper case and a lower case. Specifically, in Example 1 in FIG. 10 (*b*), male connectors attached to the opposite ends of an FPC are inserted in female connectors with terminals thereof soldered to ends of the circuit boards in the respective cases (see Japanese Patent Publication "Kokai" No. 9-82439 (pages 4–6, FIGS. 1–14), for example). In Example 2 in FIG. 10 (*c*), electrodes formed at opposite ends of an FPC are inserted in female connectors with terminals thereof soldered to ends of the circuit boards in the respective cases (see Japanese Patent Publication "Kokai" No. 8-186628 (pages 3–4, FIGS. 1–5), for example).

In the prior art noted above, while Example 1 requires four connectors, with male and female put together, Example 2 requires only two female connectors. In any case, a solder mounting step is required for attaching the connectors to the circuit boards in the cases. This results in disadvantages of the connectors becoming large in time of increasing electrodes, and a complicated element construction. There is also a disadvantage of an assembling order being restricted since it is necessary to perform the solder mounting step first.

The present invention has made having regard to the state of the art noted above, and its object is to provide a connector for realizing compactness and space saving in time of increasing electrodes, a simplified element construction and solderless mounting.

DISCLOSURE OF THE INVENTION

A connector according to the present invention has the following characteristic features.

A first characteristic feature of the present invention lies in comprising, as shown in FIGS. 1–4, 5 (*a*), 5 (*b*), 5 (*c*), 6 (*a*) and 6 (*b*), contact members 1 having elastically deformable points of contact formed in two locations, and a main connector body 2 for insulating and holding a plurality of contact members 1 arranged at intervals in a width direction with said points of contact A, B in the two locations of the respective contact members 1 being in the same positions as seen in the direction of arrangement, wherein said main connector body 2 includes a pair of socket portions 3 for receiving board ends 10 defining land electrodes 10*a*, 10*b* in two rows corresponding to said points of contact A, B of the respective contact members 1 lying in the same positions as seen in the direction of arrangement, so that the land electrodes 10*a*, 10*b* are in pressure contact with the corresponding points of contact A, B.

With this construction, the plurality of contact members having the elastically deformable points of contact formed in two locations are arranged at intervals in the direction of width. The board ends defining land electrodes in two rows corresponding to the points of contact of the respective contact members lying in the same positions as seen in the direction of arrangement are inserted, respectively, into the pair of socket portions of the main connector body which insulates and holds the contact members with the points of contact in the two locations being in the same positions as seen in the direction of arrangement. Then, the point of contacts of the contact members are pushed by the board ends to become elastically deformed, and the land electrodes formed on the board ends are placed in pressure contact with the corresponding points of contact of the contact members.

That is, when the two board ends to be connected are inserted into the pair of socket portions, respectively, the land electrodes formed on one of the board ends make a pressure contact with the points of contact in one of the two locations of the contact members, and the land electrodes formed on the other board end make a pressure contact with the points of contact in the other of the two locations of the contact members. Thus, the land electrodes of the above two board ends are conductively connected by the respective contact members.

Specifically, the inward land electrodes 10*a* of the board ends 10 contact the points of contact A of the contact members located adjacent the inlets of the socket potions, and the outward land electrodes 10*b* of the board ends 10 contact the points of contact B of the contact members located in the depths of the socket portions. Thus, the inward land electrodes 10*a* of one of the board ends and the outer land electrodes 10*b* of the other board end become conductive through the contact members. The two printed circuit boards having the board ends are connected electrically.

Thus, the main connector body insulates and holds the plurality of contact members arranged at intervals in the direction of width, and the two board ends to be connected are inserted into the main connector body to place the land electrodes of each board end in pressure contact with the points of contact in each end region of the contact members. This construction can achieve compactness and space saving by reducing the intervals at which the contact members are juxtaposed, despite an increase in the number of contact members for coping with multiple electrodes. The element construction is simple in that only the two elements, i.e. the contact members and the main connector body, are required, which achieves a reduction in die cost. Further, the two board ends have only to be placed in pressure contact with the respective contact members, without requiring solder mounting, which eliminates the restriction as to the order of mounting the board ends. In the case, for example, of an apparatus set having a plurality of units finally assembled after being manufactured in different locations, the flexibility of unit manufacture may be improved.

Thus, a connector is provided for realizing compactness and space saving in time of increased electrodes, a simplified element construction and solderless mounting.

A second characteristic feature of the present invention lies in that, in the first characteristic feature, as shown in FIGS. 4, 6 (*a*) and 6(*b*), said contact members 1 are formed in an S-shape as seen in the direction of arrangement, and are held in a middle part of the S-shape by said main connector body 2, with said points of contact A, B being formed in end regions 1*a*, 1*b* of the S-shape extending in the same direction in which said board ends 10 are inserted for pressure contact.

With this construction, the contact members formed in an S-shape as seen in the direction of arrangement are held in a middle part of the S-shape by the main connector body, with the points of contact being formed in the end regions of the S-shape extending in the same direction in which the board ends are inserted for pressure contact therewith. When the board ends are inserted, the end regions of the S-shaped contact members are pushed by the board ends, and the board ends can smoothly make a pressure contact with the point of contacts in the end regions of the S-shaped contact members. When the inserted board ends are withdrawn, the end regions of the S-shaped contact members cease to be pushed by the board ends, and can smoothly return to the original state.

With contact members formed in a V-shape or W-shape as seen in the direction of arrangement as comparative examples, when the board ends are inserted from the two opposite directions, one of the end regions of the V-shape or W-shape extends in the opposite directions to the directions of insertion of the board ends, which could deform the board ends being inserted. The S-shaped contact members according to the present invention can avoid such deformation.

Thus, a preferred embodiment of the connector is provided which has a construction for hardly deforming the contact members in time of insertion or withdrawal of the board ends such as printed circuit boards or FPCs.

A third characteristic feature of the present invention lies in that, in the first or second characteristic feature, the pair of socket portions 3 are formed in two opposite surfaces of the main connector body to receive said board ends 10 inserted in opposite directions.

With this construction, the two board ends are inserted in opposite directions into the pair of socket portions formed in the two opposite surfaces of the main connector body.

That is, the two board ends connected by the connector are arranged in the opposite sides of the connector to extend in the same direction without overlapping each other. This minimizes a mounting height and reduces a mounting space.

Thus, a preferred embodiment of the connector is provided which enables space saving in the connection and mounting of the boards using the connector.

A fourth characteristic feature of the present invention lies in that, in the first or second characteristic feature, as shown in FIGS. 2 and 4, said main connector body 2 includes partition walls 4 for defining a plurality of divisions K for individually accommodating said contact members 1, and guides 5 for guiding said contact members 1 to be accommodated in said divisions K to positions to attain said arrangement; and said contact members 1 define guided portions 1*c* to be guided by said guides 5, and held portions 1*d* for press fitting with said partition walls 4 in time of guidance into said divisions K.

With this construction, the contact members are individually placed in the plurality of divisions defined by the partition walls in the main connector body, while guiding the guided portions formed on the contact members with the guides of the main connector body. Then, the contact members are guided to positions to attain said arrangement, and the held portions formed on the contact members press fit with, to be fixedly held by, the partition walls in time of guidance into the divisions.

That is, by an operation to accommodating the plurality of contact members in the plurality of divisions formed in the main connector body, the contact members may be held in said arrangement in the main connector body.

Thus, a preferred embodiment of the connector is provided for enabling assembly by a simple operation.

A fifth characteristic feature of the present invention lies in that, in the first or second characteristic feature, as shown in FIGS. 2, 6 (*a*) and 6 (*b*), said contact members 1 are arranged in a plurality of rows with a gap in the directions of insertion of said board ends 10 into said socket portions 3.

With this construction, the contact members are arranged in a plurality of rows with a gap in the directions of insertion of said board ends into said socket portions. The board ends having the land electrodes formed in a plurality of rows and corresponding to the points of contact of the contact members are inserted into the respective socket portions, thereby establishing conduction between the land electrodes in the plurality of rows on the two board ends. That is, by arranging the contact members in a plurality of rows, while enlarging the intervals (pitch) at which the contact members are arranged in each row, an arrangement at a small pitch of the contact members is realized as the whole connector. This enables a connection of board ends having land electrodes formed with a narrow pitch.

Consequently, where, for example, the contact members are arranged in one row, because of the size (especially width) of the contact members, or for securing insulation between the contact members, the greater number of electrodes results in the greater length of the connector in the direction of arrangement of the contact members. As opposed to this, a preferred embodiment of the connector is provided which realizes compactness by minimizing the length of the connector despite an increase in the number of electrodes.

A sixth characteristic feature of the present invention lies in that, in the fifth characteristic feature, as shown in FIG. 5 (*b*), the positions of said points of contact A, B in the respective rows of said contact members 1 are staggered between the rows.

With this construction, the positions of the points of contact in the respective rows of the contact members are staggered between the rows, and the positions of the land electrodes on the board ends are also staggered between the rows in a corresponding relationship with the above.

Therefore, of the rows of land electrodes formed with a narrow pitch on the board ends, straight or near straight, simple circuit patterns may be passed between the land electrodes in the row located inward and the land electrodes in the row located outward, to draw out signal lines to the circuits in the boards.

Thus, a preferred embodiment of the connector is provided which can simplify circuit patterns on the board ends to be connected.

A seventh characteristic feature of the present invention lies in that, in the fifth characteristic feature, as shown in FIG. 2, said points of contact A, B in the two locations are different in shape from each other, and are formed in positions of rotation symmetry through 180 degrees about the middle part of each of said contact members 1, said contact members 1 being arranged in two rows, with postures of the contact members 1 in the respective rows being reversed by 180 degrees between the rows.

With this construction, the contact members with said points of contact in the two locations different in shape from each other and formed in positions of rotation symmetry through 180 degrees about the middle part, are arranged in two rows, with the postures of the contact members are reversed 180 degrees between the rows.

That is, the contact members of one type are arranged in the 180 degree posture reversal, whereby the points of contact located adjacent the inlets of the socket portions and the points of contact located in the depths have the same shapes. The contact members, when elastically deformed by the board ends inserted into the respective socket portions, are displaced in the same state.

Thus, a preferred embodiment of the connector is provided which, while communizing the contact members, can maintain an excellent connection of the contact members to the board ends inserted in the respective socket portions.

An eighth characteristic feature of the present invention lies in that, in the first or second characteristic feature, as shown in FIGS. 2, 6 (*a*) and 6 (*b*), said main connector body 2 includes retainers 6 for pressing on and holding said board ends 10 inserted in said socket portions 3.

With this construction, said board end inserted in the socket portions of said main connector body are pressed and held by the retainers provided in the main connector body, to prevent them from falling off the socket portions.

Thus, a preferred embodiment of the connector is provided which does not allow the board ends inserted in the connector to become detached with ease, thereby improving reliability in time of use.

BEST MODE FOR CARRYING OUT THE INVENTION

An embodiment of the present invention will be described hereinafter with reference to the drawings.

An embodiment of a connector according to the present invention will be described with reference to the drawings.

Figure 1:
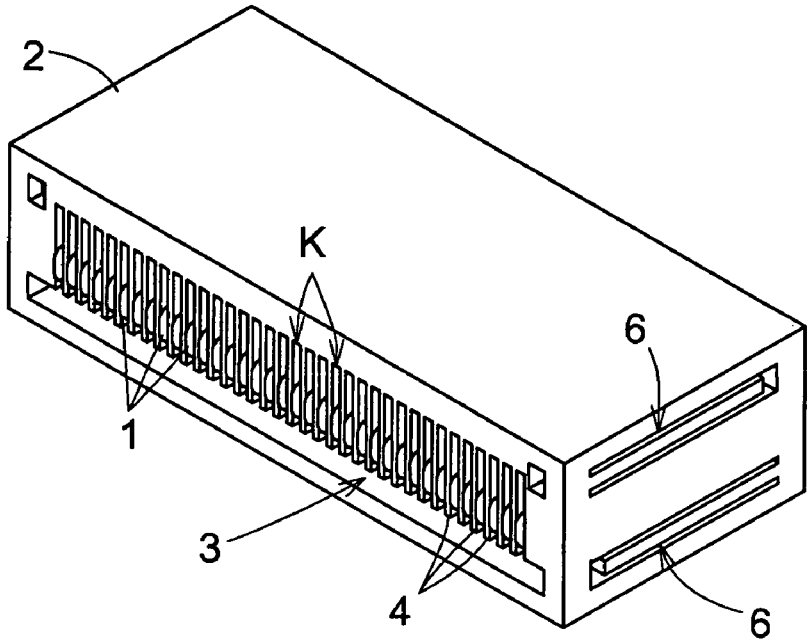
FIG. 1 is a perspective view showing an outward appearance of a connector according to the present invention.
Figure 2:
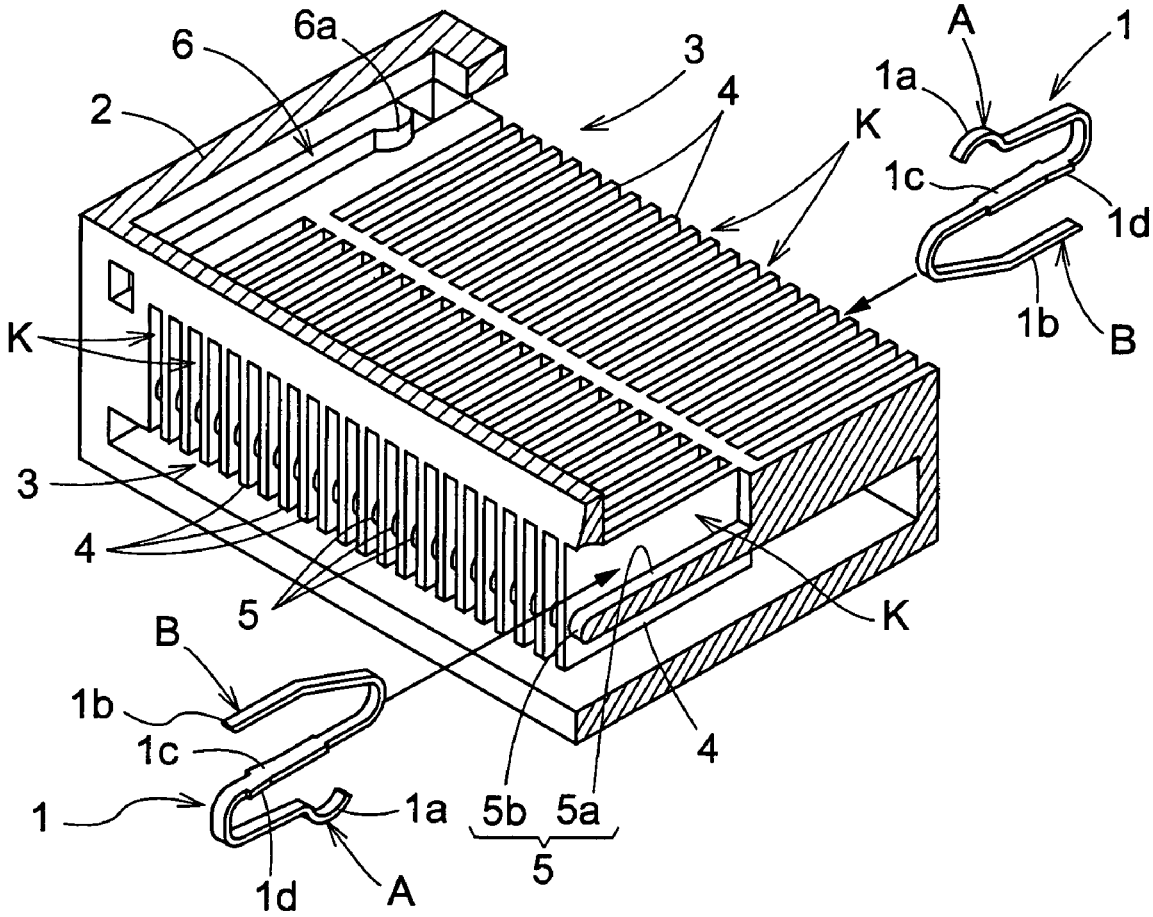
FIG. 2 is a perspective view of the connector shown with an upper portion thereof broken away.
Figure 3:
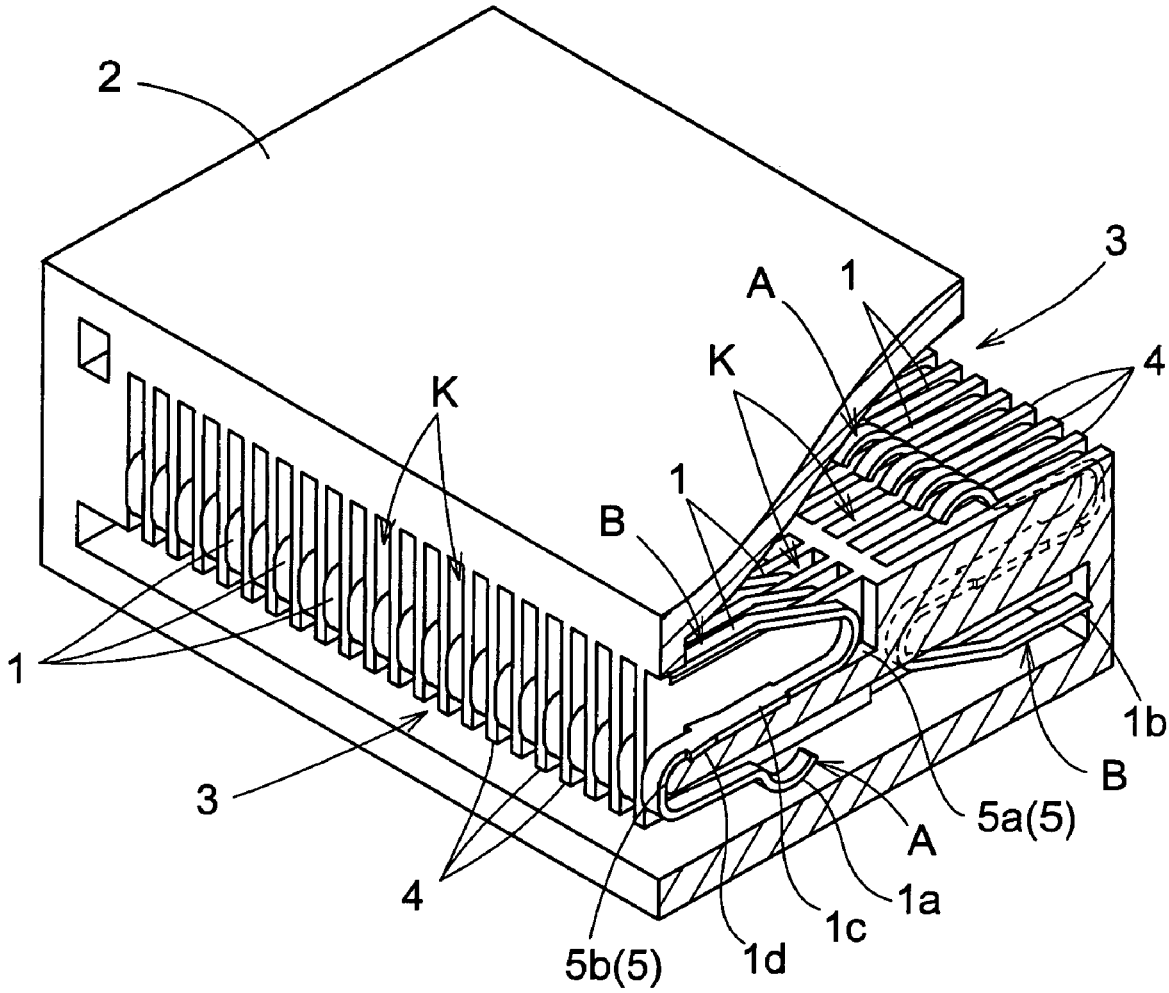
FIG. 3 is a sectional perspective view of the connector.
Figure 4:
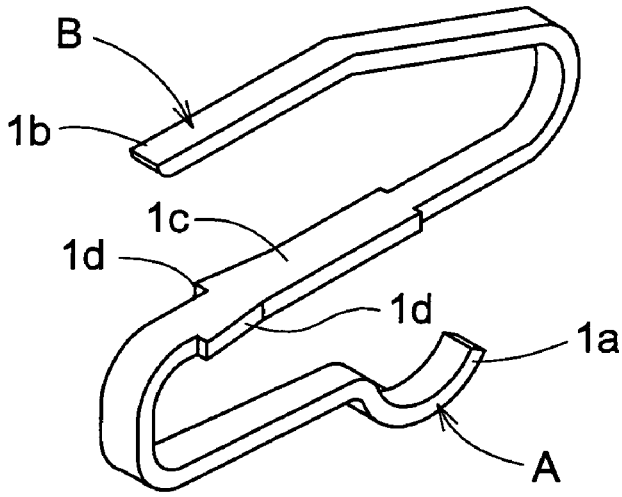
FIG. 4 is a perspective view of a contact member.
Figure 5A:
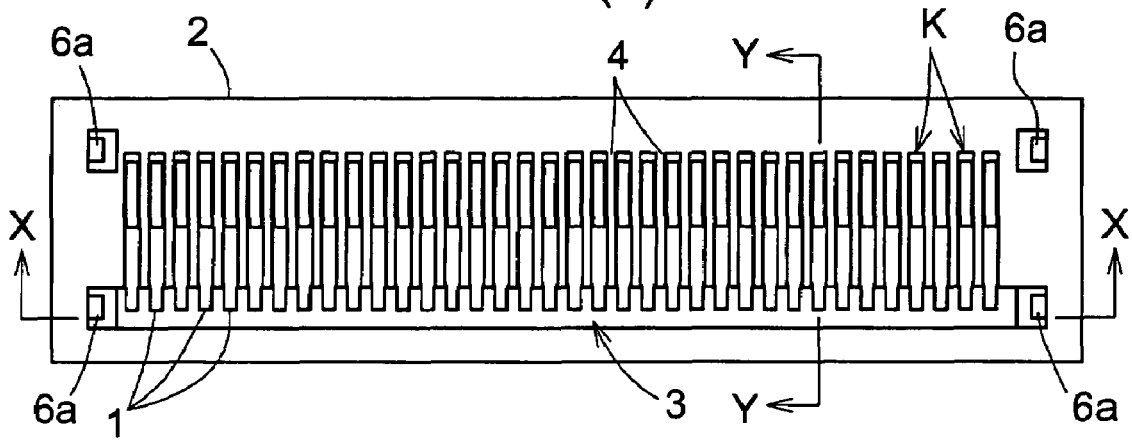
FIGS. 5 (*a*), 5 (*b*) and 5 (*c*) are a front view of a first socket side, a cross section and a front view of a second side of the connector, respectively.
Figure 5A:
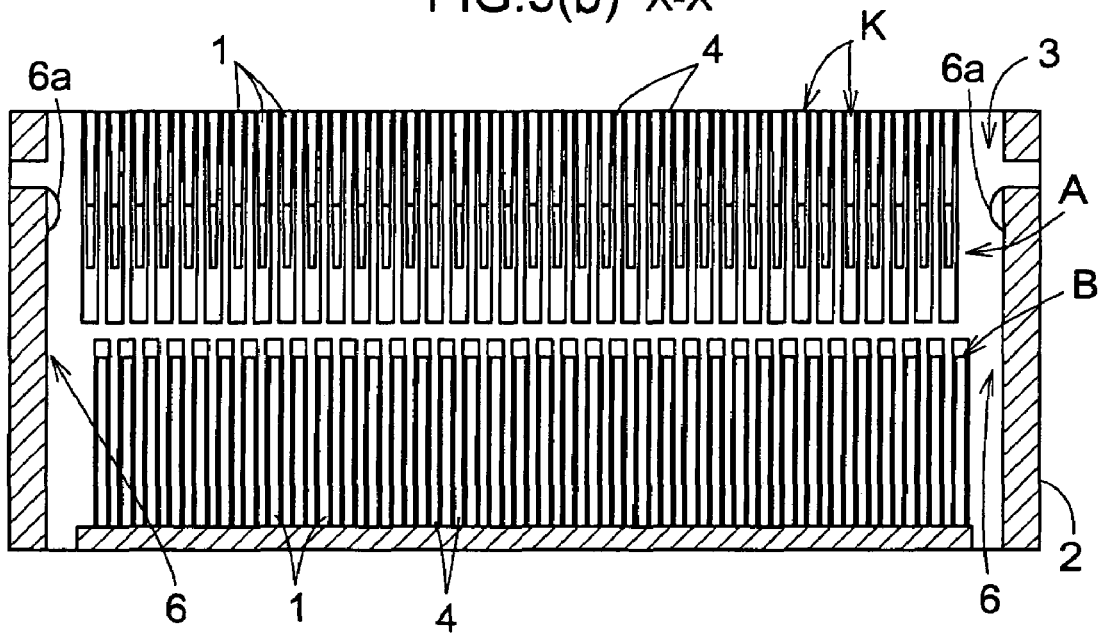
Figure 5C:
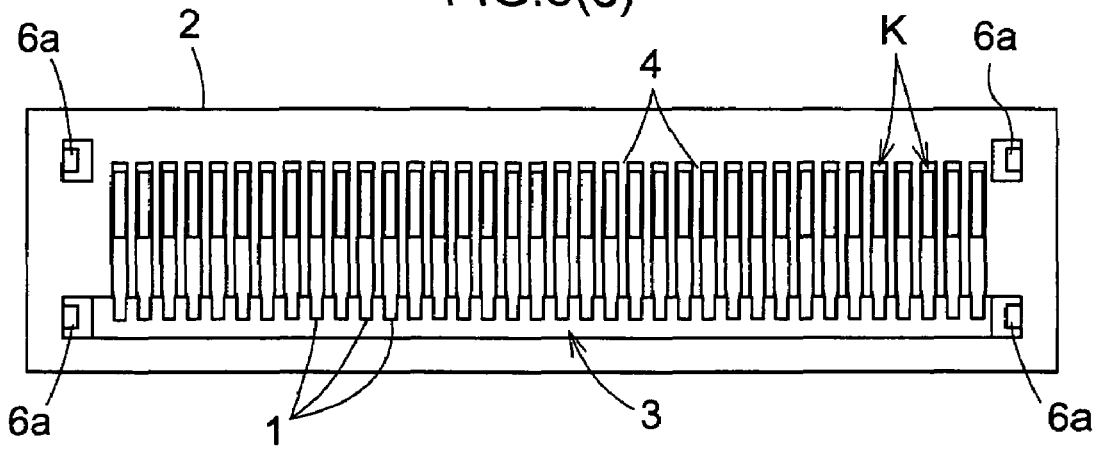
Figure 6A:
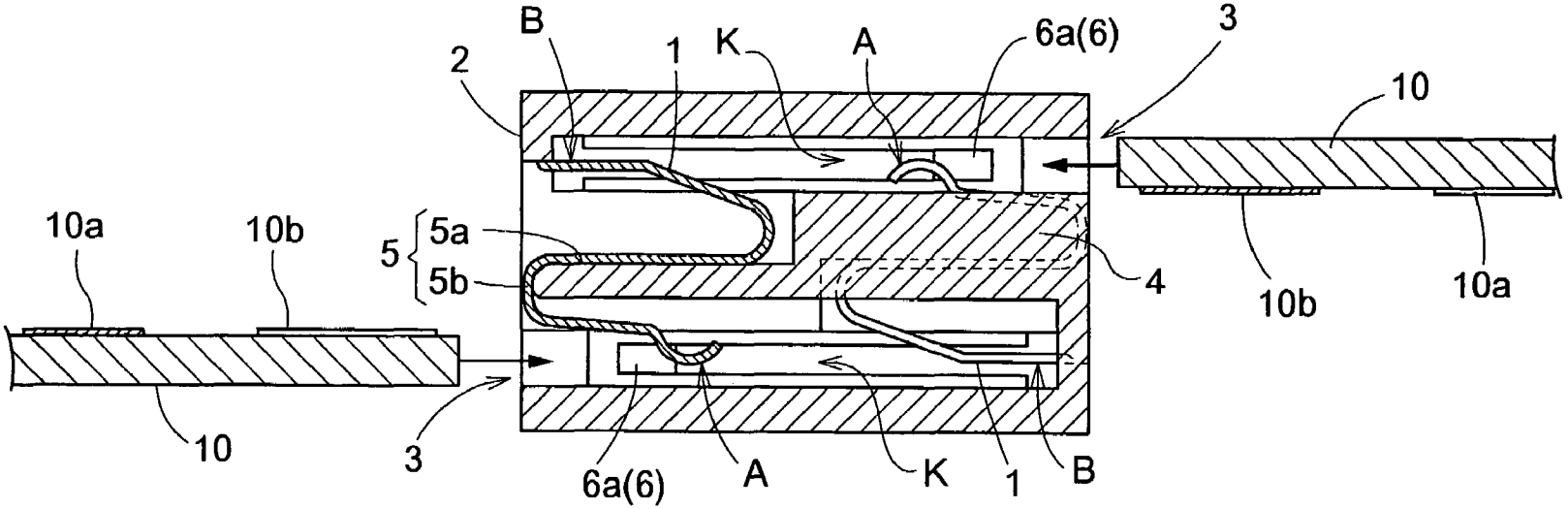
FIGS. 6 (*a*) and 6 (*b*) are views in vertical section of the connector.
Figure 6B:
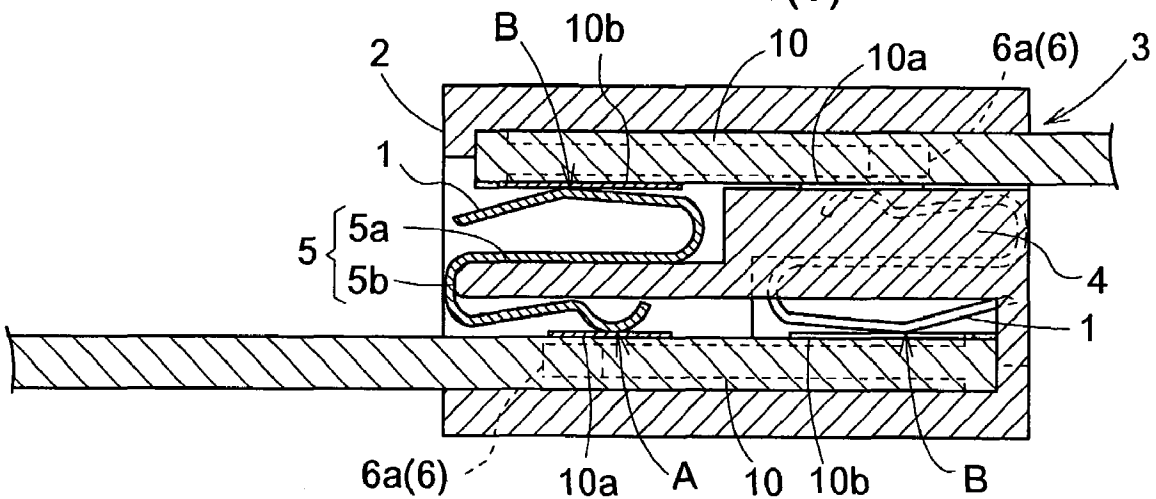

As shown in FIGS. 1–4, 5 (*a*), 5 (*b*), 5 (*c*), 6 (*a*) and 6 (*b*), the connector according to this invention includes contact members 1 having elastically deformable points of contact A and B formed in two locations, and a main connector body 2 for insulating and holding a plurality of contact members 1 arranged at intervals in a width direction with the two points of contact A and B of the respective contact members 1 being in the same positions as seen in the direction of arrangement. FIG. 5 (*b*) is a cross section taken on line X—X shown in FIG. 5 (*a*), FIGS. 6 (*a*) and 6 (*b*) are views in vertical section taken on line Y—Y shown in FIG. 5 (*a*).

The above main connector body 2 has a pair of socket portions 3 for receiving board ends 10 defining land electrodes 10*a* and 10*b* corresponding to the points of contact A and B of the respective contact members 1 lying in the same positions as seen in the direction of arrangement, so that the land electrodes 10*a* and 10*b* are in pressure contact with the corresponding points of contact A and B. The pair of socket portions 3 are formed in two opposite surfaces of the main connector body 2 to receive the board ends 10 inserted in opposite directions.

The contact members 1 are formed in an S-shape as seen in the direction of arrangement, and are held in a middle part of the S-shape by the main connector body 2, with the points of contact A and B being formed in opposite end regions 1*a* and 1*b* of the S-shape extending in the same directions in which the board ends 10 are inserted for pressure contact. The contact members 1 are formed of a copper alloy, with the above points of contact A and B plated with gold. The main connector body 2 is formed of a plastic resin.

Next, a structure for holding the contact members 1 in the main connector body 2 will be described. First, the main connector body 2 has partition walls 4 for defining a plurality of divisions K of thin width for accommodating the plurality of contact members 1, respectively, and guides 5 for guiding the contact members 1 to be accommodated in the respective divisions K to the positions forming the state of arrangement. Specifically, the guides 5 are formed of members integral with right and left partition walls 4 of the respective divisions K, and have upper surfaces 5*a* extending along the directions of insertion of the board ends 10, and receiving surfaces 5*b* at upstream ends in the directions of insertion.

On the other hand, the contact members 1 have guided portions 1*c* guided by the guides 4, and held portions 1*d* for press fitting with, to be fixedly held by, the partition walls 4 in time of guidance into the divisions K. Specifically, each S-shaped contact member 1 has, formed in the middle region thereof, a linear portion of larger width than the other portions and narrower than the division K. The upper surface 1*c* of the linear middle portion acts as the guided portion 1*c*, and a pair of right and left tapered portions formed on side surfaces of the linear middle portion as staggered along the direction of insertion and protruding in obliquely sideways directions act as the held portions 1*d*.

The contact members 1 are arranged in a plurality of rows with a gap in the directions of insertion of the board ends 10 into the socket portions 3. The positions of the points of contact A and B in the rows of the contact members 1 are staggered from one another between the rows. Specifically, the contact members 1 are arranged in two rows, and the positions of the points of contact A and B are staggered by half (½ pitch) the pitch (e.g. 0.5 mm) between the rows. In a corresponding relationship to this, the land electrodes 10*a* and 10*b* of the board ends 10 inserted are also formed in two rows, and the positions of the land electrodes 10*a* and 10*b* are staggered between the rows by ½ pitch.

The two points of contact A and B of each contact member are different in shape, and are formed in positions of rotation symmetry through 180 degrees about the middle position of the contact member 1. The postures of the contact members 1 in the rows are reversed by 180 degrees between the rows. As a result, the inward land electrodes 10*a* of the board ends 10 contact the points of contact A of the contact members 1 located adjacent the inlets of the socket portions 3, and the outward land electrodes 10*b* of the board ends 10 contact the points of contact B of the contact members 1 located in the depths of the socket portions 3. Thus, the inward land electrodes 10*a* of one of the board ends 10 and the outward land electrodes 10*b* of the other board end 10 become conductive through the contact members 1. The two printed circuit boards having the board ends 10 are connected electrically.

The main connector body 2 includes retainers 6 for pressing on and holding the board ends 10 inserted in the socket portions 3. Specifically, right and left side walls of each socket portion 3 have elastic pieces 6 having proximal ends located in the depth in the direction of insertion, and distal ends with projections 6*a* for contacting lateral positions of the board end 10. The elastic pieces 6 act as the retainers 6.

Figure 7:
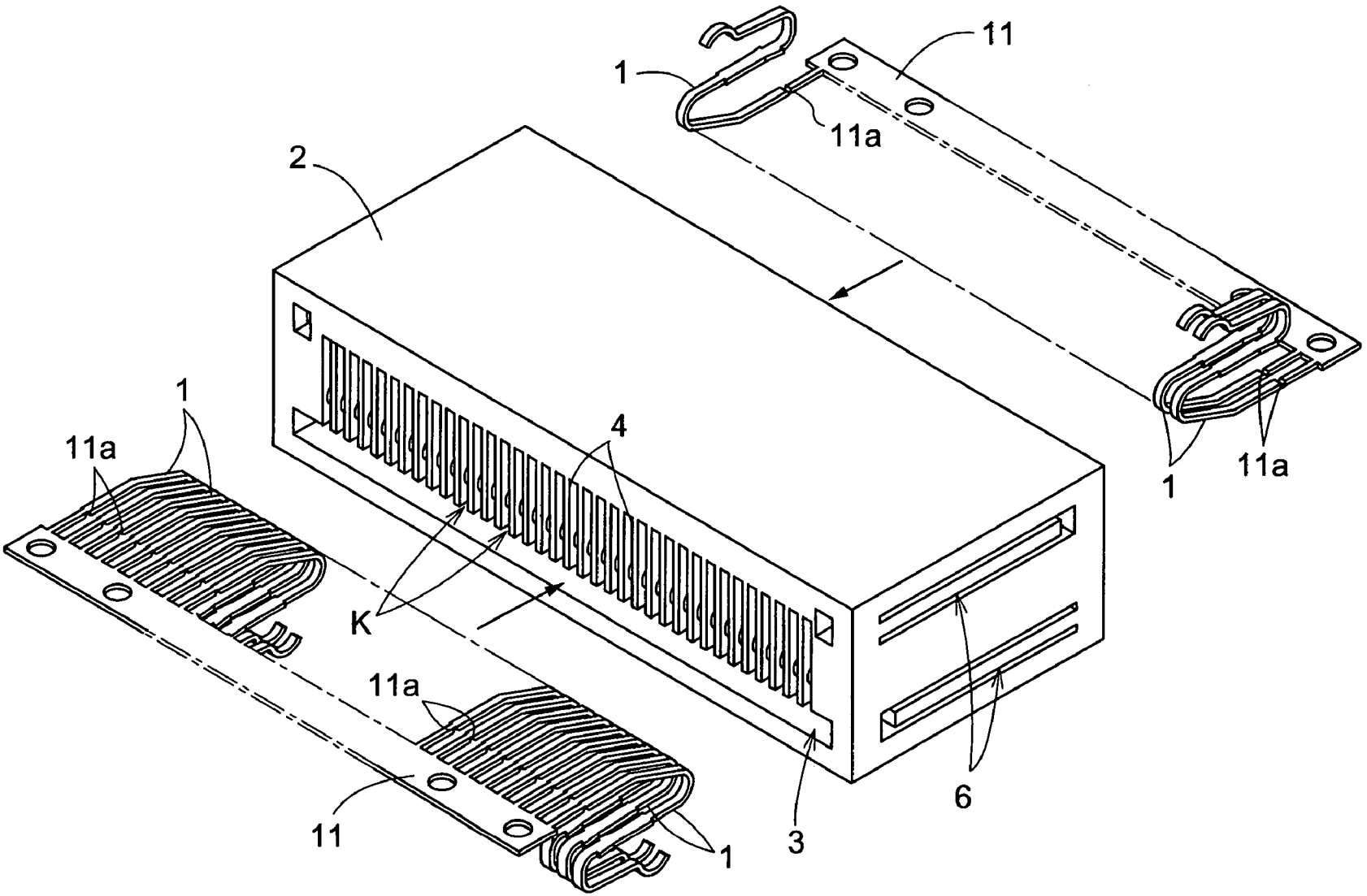
FIG. 7 is a perspective view showing an assembled state of the connector.

Next, a method of assembling the connector will be described. As shown in FIG. 7, the contact members 1 are held by carriers 11 as arranged in the two separate rows. With the carriers 11 gripped by inserting jigs not shown, the contact members 1 are inserted from the two opposite faces of the main connector body 2 to be placed in the corresponding divisions K, respectively. In time of this insertion, the upper surfaces 1*c* of the linear middle portions of the contact members 1 are guided by the upper surfaces 5*a* of the guides 5 of the main connector body 2, and the insertion is stopped when the contact members 1 abut with the receiving surfaces 5*b* of the guides 5 of the main connector body 2. At the same time, the tapered portions 1*d* formed on the side surfaces of the linear middle portions of the contact members 1 press fit with the partition walls 4 of the main connector body 2 to be thereby held in place. The postures of the contact members 1 inserted from the two surfaces are vertically reversed, whereby, in the socket portions 3, the points of contact adjacent the inlets and in the depths are located in the same positions (the points of contact A being adjacent the inlets and the points of contact B being in the depths). Finally, each contact member 1 is cut at a cutout part and separated from the carrier 11*a*.

Next, an example of using the connector of the present invention to connect a printed circuit board and an FPC will be described.

Figure 8A:
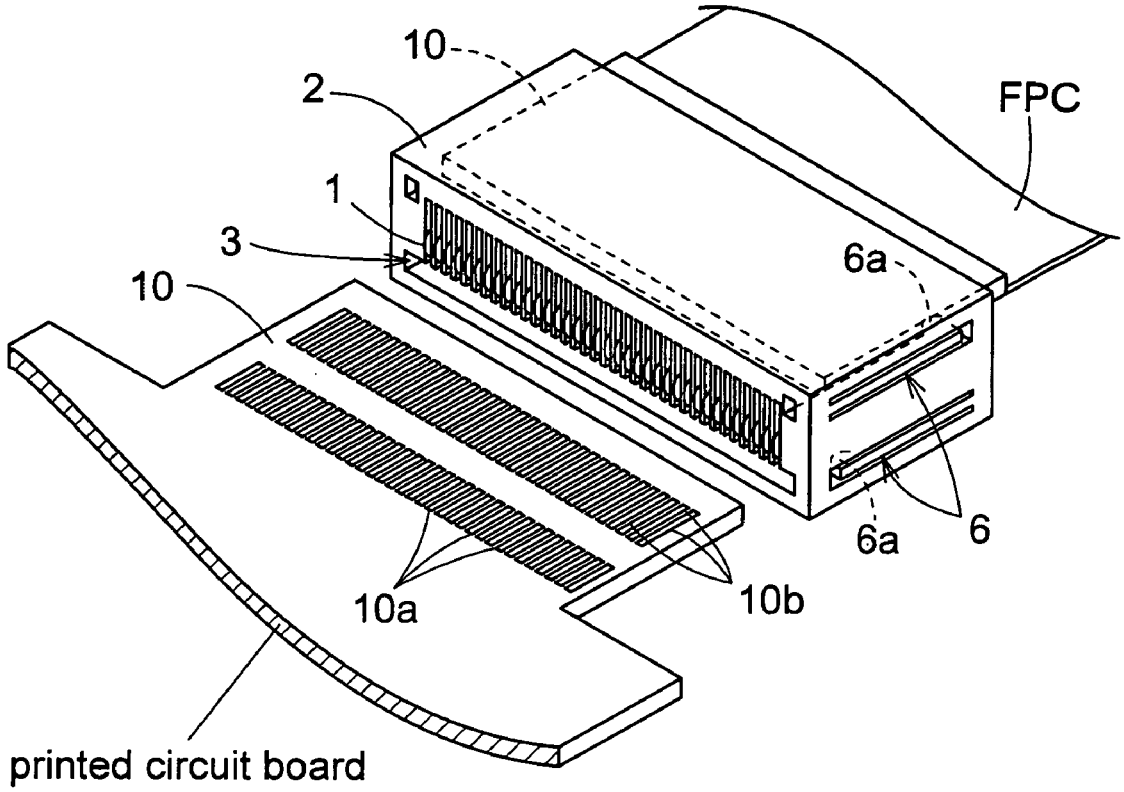
FIGS. 8 (*a*) and 8 (*b*) are perspective views showing examples of connection using the connector.
Figure 8B:
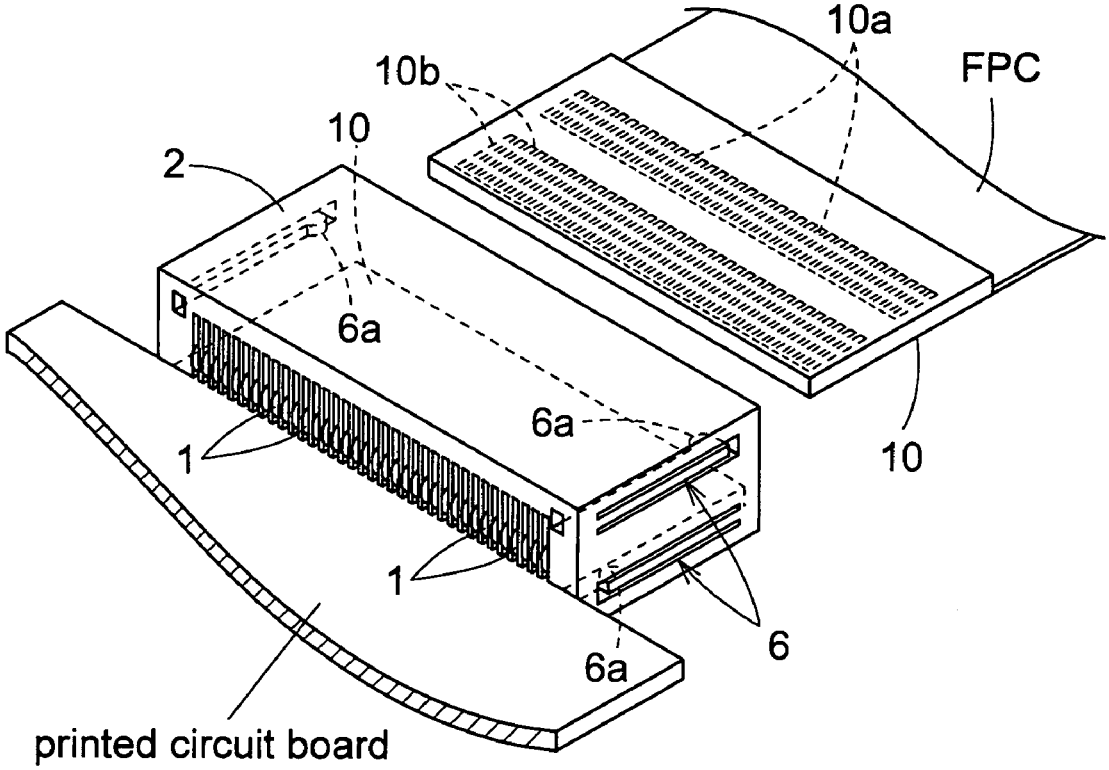

FIG. 8 (*a*) shows a case of first inserting the FPC into one of the socket portions 3 of the connector, and thereafter inserting the printed circuit board into the other socket portion 3 of the connector, and FIG. 8 (*b*) shows a case of first inserting the printed circuit board into one of the socket portions 3 of the connector, and thereafter inserting the FPC board into the other socket portion 3 of the connector. Although not shown, it is also possible to connect printed circuit boards or FPCs to each other by the same operation. The above printed circuit board and FPC have, formed in each end region thereof, two rows of land electrodes 10*a* and 10*b* in forward and rearward positions in the direction of insertion, and staggered by ½ pitch (e.g. 0.25 mm).

In the above connection, where at least one of the objects connected is a printed circuit board, a mounting position of the connector is determined by inserting the connector in the printed circuit board since, usually, the printed circuit board is fixedly supported in a housing, case or the like. Where FPCs are connected, since FPCs usually are not fixed, it is necessary to mount the connector as supported by using a separate holding member.

Figure 9A:
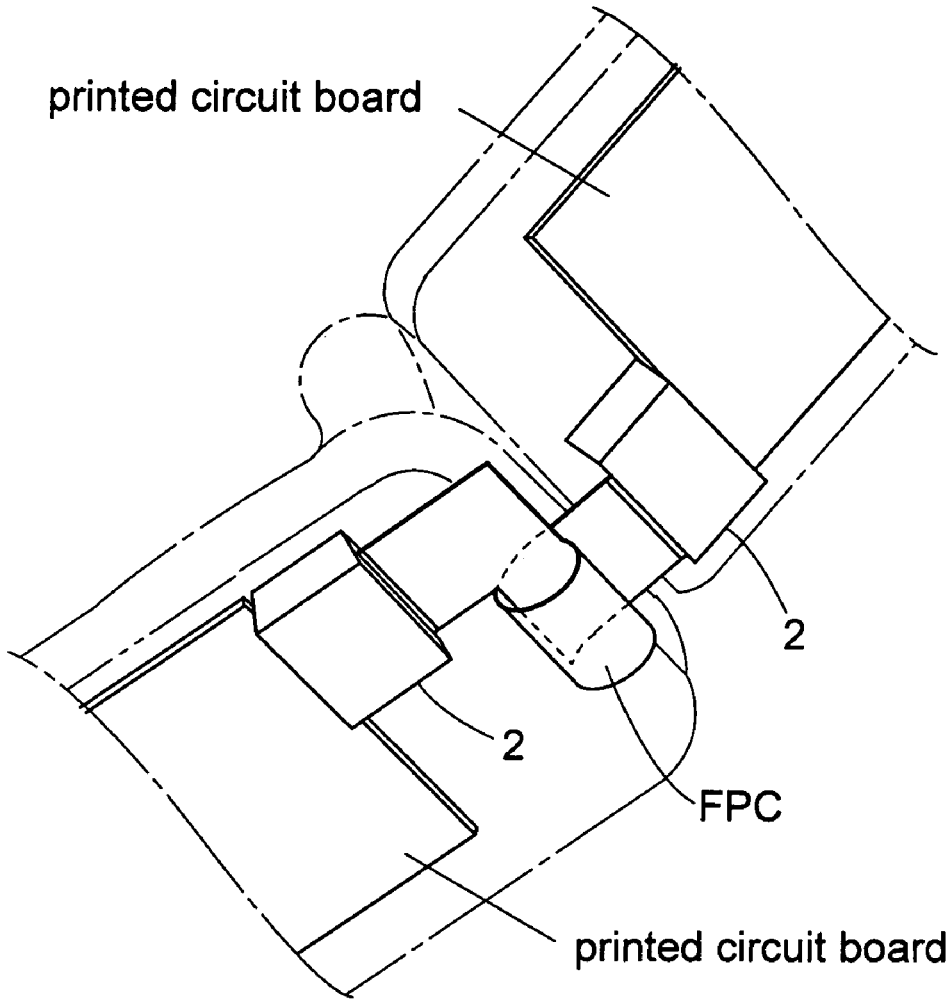
FIGS. 9 (*a*) and 9 (*b*) are views showing an example of mounting of the connector on a device.
Figure 9B:
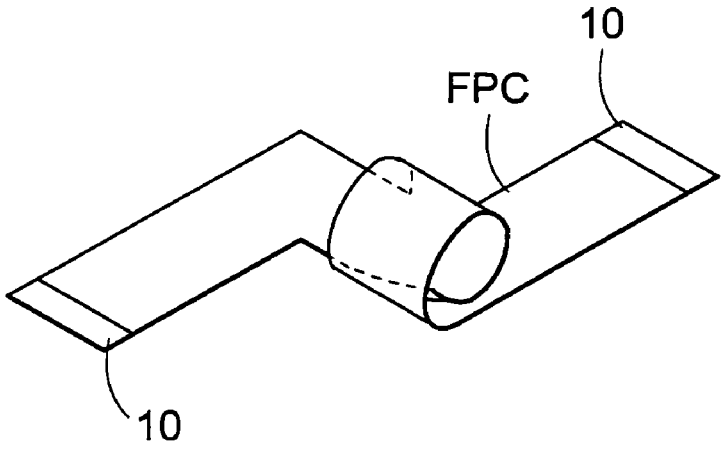
Figure 10A:
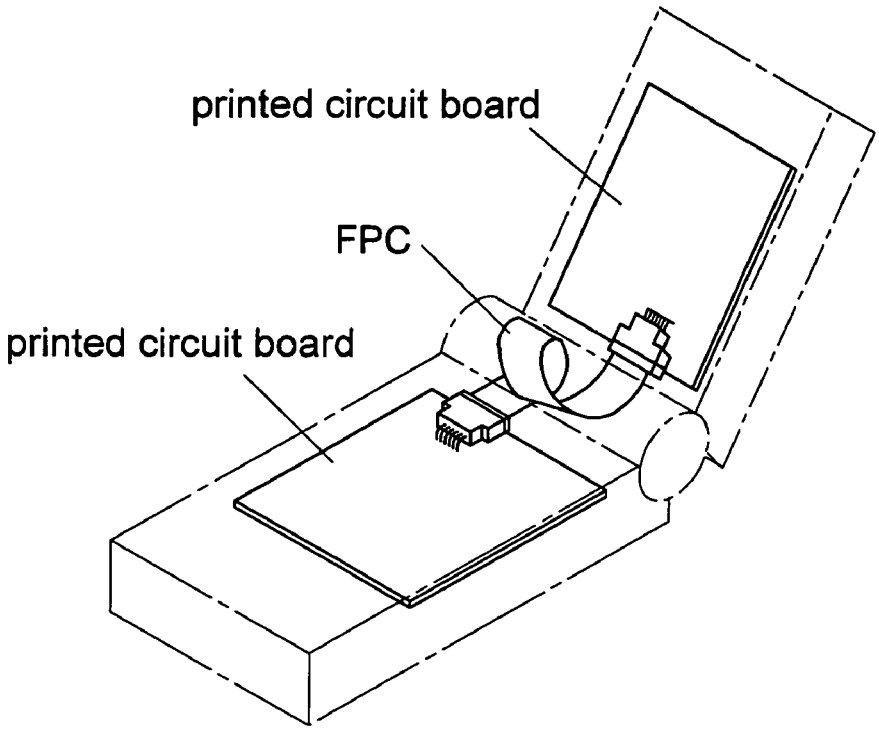
FIGS. 10 (*a*), 10 (*b*) and 10 (*c*) are views showing examples of mounting on a device of connectors in the prior art.
Figure 10B:
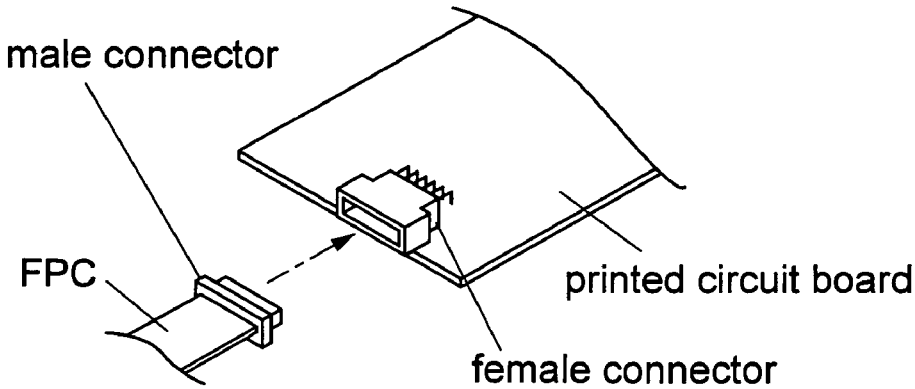
Figure 10C:
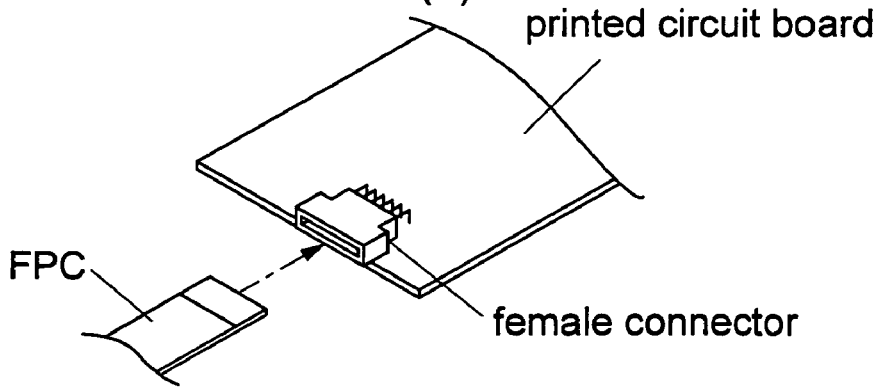

Next, FIGS. 9 (*a*) and 9 (*b*) show a case of using connectors of the present invention to connect, at a bending part of a folding type cell phone, the printed circuit boards in the upper case and the printed circuit board in the lower case. Specifically, as shown in FIG. 9 (*a*), an end of the printed circuit board disposed in each case is inserted into and connected to one of the socket portions 3 of one of the connectors of the present invention. Next, the land electrodes formed at the opposite ends of an FPC disposed in a rolled state at the above bending part are inserted into and connected to the other socket portions 3 of the respective connectors. FIG. 9 (*b*) shows a perspective view of the FPC alone.

Other Embodiments

<1> The contact members 1 are formed in an S-shape as seen in the direction of arrangement in the above embodiment, but may be formed in various other shapes. The elastically deformable points of contact A and B may also be formed, as appropriate, on parts other than the end regions of the contact members 1.

<2> The contact members 1 are arranged in two rows by way of arranging them in a plurality of rows in the above embodiment, but they may be arranged in three or more rows. Where the positions of the points of contact A and B of the contact members 1 arranged in a plurality of rows are staggered between the rows, an appropriate amount of stagger may be selected which is other than half the pitch (½ pitch) of arrangement of the points of contact A and B in the rows. The contact members 1 may be arranged in one row instead of a plurality of rows.

INDUSTRIAL UTILITY

The connector according to this invention may be used for connecting printed circuit boards, flexible printed wiring boards (hereinafter abbreviated to FPC), or a printed circuit board and an FPC, for example.

The invention claimed is:

1. A connector comprising:

contact members comprising elastically deformable points of contact formed in two locations, wherein the contact members have a first leg, a second leg, and an intermediate leg interconnecting an end of the first leg to an end of the second leg such that the contact members, when viewed lying in a plane, have an S-shape, with one of the locations on the first leg and the other one of the locations on the second leg, with the points of contact facing away from one another in opposite directions;

and a main connector body for insulating and holding a plurality of contact members arranged at intervals in a width direction with said points of contact in the two locations of the respective contact members being in the same positions as seen in the direction of arrangement, wherein said main connector body includes a pair of socket portions for receiving board ends defining land electrodes in two rows corresponding to said points of contact of the respective contact members lying in the same positions as seen in the direction of arrangement, so that the land electrodes are in pressure contact with the corresponding points of contact.

2. The connector as defined in claim 1, wherein space of said contact members between the first leg and the intermediate leg receives a guide of said main connector body to mount said contacts in the connector body, with said points of contact extending in the same direction in which said board ends are inserted for pressure contact.

3. The connector as defined in claim 1, wherein said pair of socket portions are formed in two opposite surfaces of said main connector body and offset from one another to receive said board ends inserted in opposite directions.

4. The connector as defined in claim 2, wherein said main connector body comprises a first side, an opposite second side, a top side, and a bottom side, with one of said pair of socket portions in the first side adjacent the top side and the other one of said socket portions in the second side adjacent the bottom side to receive said board ends inserted in opposite directions.

5. The connector as defined in claim 1, wherein:

said main connector body includes partition walls for defining a plurality of divisions for individually accommodating said contact members, and guides for engaging the space between the first leg and the intermediate leg of the contact member to guide said contact members into said divisions to positions to attain said arrangement; and said contact members comprising held portions for press fitting with said partition walls in time of guidance into said divisions.

6. The connector as defined in claim 2, wherein:

said main connector body includes partition walls for defining a plurality of divisions for individually accommodating said contact members, and the guides for guiding said contact members to be accommodated in said divisions to positions to attain said arrangement; and said intermediate leg of said contact members further comprising tapered portions formed on side surfaces for press fitting with said partition walls in time of guidance into said divisions.

7. The connector as defined in claim 1, wherein said contact members are arranged in a plurality of rows with a gap in the directions of insertion of said board ends into said socket portions.

8. The connector as defined in claim 7, wherein the positions of said points of contact in the respective rows of said contact members are staggered between the rows.

9. The connector as defined in claim 1, wherein said main connector body includes retainers for pressing on and holding said board ends inserted in said socket portions.

10. The connector as defined in claim 2, wherein said main connector body includes retainers for pressing on side portions of said board ends to hold said board ends when inserted in said socket portions.

11. A connector comprising contact members having elastically deformable points of contact formed in two locations, and a main connector body for insulating and holding a plurality of contact members arranged at intervals in a width direction with said points of contact in the two locations of the respective contact members being in the same positions as seen in the direction of arrangement, wherein said main connector body includes a pair of socket portions for receiving board ends defining land electrodes in two rows corresponding to said points of contact of the respective contact members lying in the same positions as seen in the direction of arrangement, so that the land electrodes are in pressure contact with the corresponding points of contact, wherein said contact members are arranged in a plurality of rows with a gap in the directions of insertion of said board ends into said socket portions, and wherein said points of contact in the two locations are different in shape from each other, and are formed in positions of rotation symmetry through 180 degrees about the middle part of each of said contact members, said contact members being arranged in two rows, with postures of the contact members in the respective rows being reversed by 180 degrees between the rows.

12. The connector as defined in claim 2, wherein said main connector body comprises a top side and an opposite bottom side, wherein said contact members are arranged in first and second rows with a gap in the directions of insertion of said board ends into said socket portions, and wherein the first leg of the contact member of the first row is biased toward the top side and the first leg of the contact member of the second row is biased toward the second side.

13. The connector as defined in claim 12, wherein the positions of said points of contact in the respective rows of said contact members are staggered between the rows.

14. The connector as defined in claim 12, wherein said points of contact in the two locations are different in shape from each other, and are formed in positions of rotation symmetry through 180 degrees about the middle part of each of said contact members, said contact members being arranged in two rows, with postures of the contact members in the respective rows being reversed by 180 degrees between the rows.

15. The connector as defined in claim 11, wherein said contact members are formed in an S-shape as seen in the direction of arrangement, and are held in a middle part of the S-shape by said main connector body, with said points of contact being formed in end regions of the S-shape extending in the same direction in which said board ends are inserted for pressure contact.

* * * * *